US009236650B2

(12) United States Patent
Kim et al.

(10) Patent No.: US 9,236,650 B2
(45) Date of Patent: Jan. 12, 2016

(54) MOBILE TERMINAL

(75) Inventors: Changil Kim, Gyeonggi-Do (KR); Seungwoo Ryu, Gyeonggi-Do (KR); Yeomin Youn, Gyeoggi-Do (KR); Kyunghack Yi, Seoul (KR); Namyong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 290 days.

(21) Appl. No.: 13/337,976

(22) Filed: Dec. 27, 2011

(65) Prior Publication Data

US 2012/0313827 A1 Dec. 13, 2012

(30) Foreign Application Priority Data

Jun. 10, 2011 (KR) ..... 10-2011-0056451

(51) Int. Cl.

| | |
|---|---|
| ***H01Q 1/24*** | (2006.01) |
| ***H01Q 1/38*** | (2006.01) |
| ***H01Q 9/04*** | (2006.01) |
| ***H01Q 21/30*** | (2006.01) |
| ***H01Q 5/357*** | (2015.01) |
| ***H01Q 5/364*** | (2015.01) |

(52) U.S. Cl.

CPC ..... *H01Q 1/243* (2013.01); *H01Q 1/38* (2013.01); *H01Q 5/357* (2015.01); *H01Q 5/364* (2015.01); *H01Q 9/04* (2013.01); *H01Q 21/30* (2013.01)

(58) Field of Classification Search

CPC ..... H01Q 5/364; H01Q 1/243

See application file for complete search history.

(56) References Cited

U.S. PATENT DOCUMENTS

| | | | | |
|---|---|---|---|---|
| 2006/0158379 | A1* | 7/2006 | Ishimiya | 343/702 |
| 2006/0293078 | A1 | 12/2006 | Qi et al. | |
| 2007/0040755 | A1 | 2/2007 | Na et al. | |
| 2007/0115183 | A1 | 5/2007 | Kim et al. | |
| 2007/0159298 | A1 | 7/2007 | Zegelin et al. | |
| 2010/0134366 | A1 | 6/2010 | Yu | |
| 2010/0137042 | A1 | 6/2010 | Na et al. | |
| 2011/0043427 | A1 | 2/2011 | Lee et al. | |
| 2011/0109515 | A1* | 5/2011 | Rao | 343/702 |
| 2011/0241964 | A1 | 10/2011 | Kim | |

FOREIGN PATENT DOCUMENTS

| | | | |
|---|---|---|---|
| CN | 101753649 | A | 6/2010 |
| EP | 1 294 049 | A1 | 3/2003 |
| EP | 1 684 379 | A1 | 7/2006 |
| KR | 10-2009-0104333 | A | 10/2009 |
| KR | 10-2010-0070969 | A | 6/2010 |
| KR | 10-2011-0044576 | A | 4/2011 |

* cited by examiner

*Primary Examiner* — Hoang V Nguyen
*Assistant Examiner* — Michael Bouizza
(74) *Attorney, Agent, or Firm* — Birch, Stewart, Kolasch & Birch, LLP

(57) ABSTRACT

A mobile terminal according to an aspect of the invention may include: a terminal body having a ground; and conductive members embedded in the terminal body, bent at at least one point, extending in a first direction, separated from each other in directions crossing the first direction, and having a set of ends connected to form a loop, wherein a first conductive member electrically connected to a feed connection portion to feed the first conductive member and a second conductive member electrically connected to the ground to ground the second conductive member among the conductive members are separated from each other and arranged adjacent to each other to transmit and receive a radio signal while coupling occurs between the first and second conductive members extending in the first direction.

19 Claims, 8 Drawing Sheets

MOBILE TERMINAL

CROSS-REFERENCE TO RELATED APPLICATION

Pursuant to 35 U.S.C. §119(a), this application claims the benefit of earlier filing date and right of priority to Korean Application No. 10-2011-0056451, filed on Jun. 10, 2011 the contents of which is incorporated by reference herein in its entirety.

BACKGROUND OF THE INVENTION

1. Field of the Invention

The present invention relates to a mobile terminal having an antenna part transmitting and receiving a radio signal.

2. Background of the Invention

In general, a terminal may be classified into a mobile (portable) terminal and a stationary terminal according to a moveable state. The mobile terminal may be also classified into a handheld terminal and a vehicle mount terminal according to a user's carriage method.

As functions of the terminal become more diversified, the terminal can support more complicated functions such as capturing images or video, reproducing music or video files, playing games, receiving broadcast signals, and the like. By comprehensively and collectively implementing such functions, the mobile terminal may be embodied in the form of a multimedia player or a device.

Various attempts have been made to implement complicated functions in such a multimedia device by means of hardware or software. For instance, a user interface environment is provided in a portable terminal to enable a user to easily and conveniently search for or select a desired function among available functions.

Also, as mobile terminals are considered as personal belongings designed to make a fashion statement, various design forms are being required. Design forms may include structural changes and improvements that make mobile terminals user-friendly. Antennas can be considered as one of these structural changes and improvements.

SUMMARY OF THE INVENTION

Therefore, an aspect of the detailed description is to provide a mobile terminal having an antenna device offering enhanced performance of transmitting and receiving multi radio signals in low and high frequency bands within a smaller space.

To achieve these and other advantages and in accordance with the purpose of this specification, as embodied and broadly described herein, according to an aspect of the present invention, there is provided a mobile terminal including: a terminal body having a ground; and conductive members embedded in the terminal body, bent at at least one point, extending in a first direction, separated from each other in directions crossing the first direction, and having a set of ends connected to form a loop, wherein a first conductive member electrically connected to a feed connection portion to feed the first conductive member and a second conductive member electrically connected to the ground to ground the second conductive member among the conductive members are separated from each other and arranged adjacent to each other to transmit and receive a radio signal while coupling occurs between the first and second conductive members extending in the first direction.

A third conductive member and a fourth conductive member among the conductive members may be separated from the first conductive member or the second conductive member.

In order to form the loop, the third conductive member may have one end connected to the first conductive member and the other end connected to the fourth conductive member, and the fourth conductive member may have one end not connected to the third conductive member but connected to the second conductive member.

A path from one end of the first conductive member to be fed to the second conductive member to be grounded via the third conductive member and the fourth conductive member may have a predetermined length to transmit and receive a first frequency band corresponding to long term evolution (LTE).

The first conductive member and the second conductive member may extend in the first direction in parallel with each other by a predetermined length and be coupled to each other in order to form a physical length corresponding to the first frequency band within a limited space of the terminal body.

In order to form the physical length, a feed connection portion electrically connecting the ground and the first conductive member to feed the first conductive member and a ground connection portion electrically connecting the ground and the first conductive member to ground the second conductive member may be arranged adjacent to respective end portions of the first and second conductive members being away from central areas thereof.

The third conductive member may be formed as a planar patch.

According to an aspect of the present invention, there is provided a mobile terminal including: a terminal body having a ground; and a plurality of conductive members embedded in the terminal body and extending in a first direction and separated from each other in a second direction crossing the first direction to transmit and receive a radio signal, wherein the conductive members have a first conductive member arranged between a second conductive member and a third conductive member, the first conductive member having one end connected to the ground, the first conductive member and the second conductive member are separated from each other by a first interval to achieve capacitive coupling, and the first conductive member and the third conductive member are separated from each other by a second interval to achieve inductive coupling.

As a result, in the antenna device according to the exemplary embodiment of the present invention, the plurality of conductive members extend in parallel with each other to achieve coupling therebetween, thereby reducing resonance frequency in a common mode and a different mode, so that desired low-frequency band performance, particularly, more enhanced antenna performance in LTE band can be achieved with a shorter resonance length.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
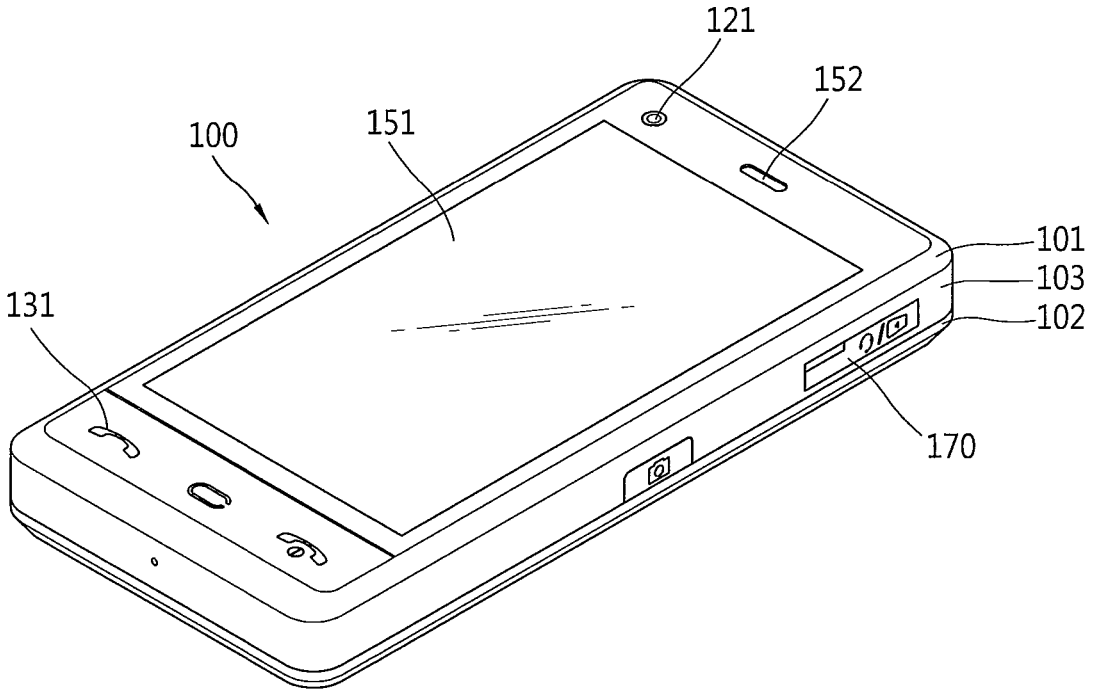
FIG. 1 is a front perspective view illustrating a front view of a mobile terminal according to an exemplary embodiment of the present invention.

Hereinafter, a mobile terminal according to the present disclosure will be explained in more detail with reference to the attached drawings The suffixes attached to components of the mobile terminal, such as 'module' and 'unit or portion' were used for facilitation of the detailed description of the present disclosure. Therefore, the suffixes do not have different meanings from each other. The same reference numerals will be given to the same components as those of the aforementioned embodiment, and their explanations will be omitted. The singular expression of the present disclosure may include a plural concept unless distinctively differently defined.

The mobile terminal according to the present disclosure may include a portable phone, a smart phone, a laptop computer, a digital broadcasting terminal, Personal Digital Assistants (PDA), Portable Multimedia Player (PMP), a navigation system, etc., and a fixed terminal such as a digital TV, a desktop computer, etc.

FIG. 1 is a front perspective view of a mobile terminal 100 according to the present invention.

The mobile terminal 100 may be a bar-type mobile terminal consisting of one body. However, the present disclosure is not limited to this. That is, the present disclosure may be applicable to various structures such as a slide type where at least two bodies are coupled to each other so as to perform a relative motion, a folder type, a swing type, a swivel type, etc.

A case (casing, housing, cover, etc.) forming an outer appearance of a body may include a front case 101 and a rear case 102. A space formed by the front case 101 and the rear case 102 may accommodate various components therein. At least one intermediate case may further be disposed between the front case 101 and the rear case 102.

Such cases may be formed by injection-molded synthetic resin, or may be formed using a metallic material such as stainless steel (STS) or titanium (Ti).

At the front case 101, may be disposed a display unit 151, an audio output unit 152, a camera 121, user input units 131 and 132, a microphone 122, an interface unit 170, etc.

The display unit 151 occupies most parts of a main surface of the front case 101. The audio output unit 152 and the camera 121 are arranged at a region adjacent to one end of the display unit 151, and the user input unit 131 and the microphone 122 are arranged at a region adjacent to another end of the display unit 151. The user input unit 132, the interface unit 170, etc. may be arranged on side surfaces of the rear case 102.

The display unit 151 may display information processed in the mobile terminal 100. For example, when the mobile terminal 100 is in a phone call mode, the display unit 151 may display a User Interface (UI) or a Graphic User Interface (GUI) associated with a call or other communication (such as text messaging, multimedia file downloading, etc.). When the mobile terminal 100 is in a video call mode or image capturing mode, the display unit 151 may display a captured image and/or received image, a UI or GUI that shows videos or images and functions related thereto, and the like.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like.

Some of these displays may be configured to be transparent so that outside may be seen therethrough, which may be referred to as a transparent display. A representative example of the transparent display may include a Transparent Organic Light Emitting Diode (TOLED), and the like. The rear surface portion of the display unit 151 may also be implemented to be optically transparent. Under this configuration, a user can view an object positioned at a rear side of a body through a region occupied by the display unit 151 of the body.

The display unit 151 may be implemented in two or more in number according to a configured aspect of the mobile terminal 100. For instance, a plurality of displays may be arranged on one surface integrally or separately, or may be arranged on different surfaces.

Here, if the display unit 151 and a touch sensitive sensor (referred to as a touch sensor) have a layered structure therebetween, the structure may be referred to as a touch screen. The display unit 151 may be used as an input device rather than an output device. The touch sensor may be implemented as a touch film, a touch sheet, a touch pad, and the like.

The interface unit 170 may generally be implemented to interface the mobile terminal with external devices. The interface unit 170 may allow a data reception from an external device, a power delivery to each component in the mobile terminal 100, or a data transmission from the mobile terminal 100 to an external device. The interface unit 170 may include, for example, wired/wireless headset ports, external charger ports, wired/wireless data ports, a card socket (e.g., memory card, SIM/UIM card, etc.), and the like.

The touch sensor may be configured to convert changes of a pressure applied to a specific part of the display unit 151, or a capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller (not shown). The touch controller processes the received signals, and then transmits corresponding data to the controller 180. Accordingly, the controller 180 may sense which region of the display unit 151 has been touched.

The user input unit is manipulated to receive a command for controlling the operation of the mobile terminal 100, and may include a plurality of manipulation units 131 and 132. The manipulation units 131 and 132 may be referred to as manipulating portions, and may include any type of ones that can be manipulated in a user's tactile manner.

Commands inputted through the manipulation units 131 and 132 may be variously set. For instance, the first manipulation unit 131 is configured to input commands such as START, END, SCROLL or the like, and the second manipulation unit 132 is configured to input commands for controlling a level of sound outputted from the audio output unit 152, or commands for converting the current mode of the display unit 151 to a touch recognition mode.

Figure 2:
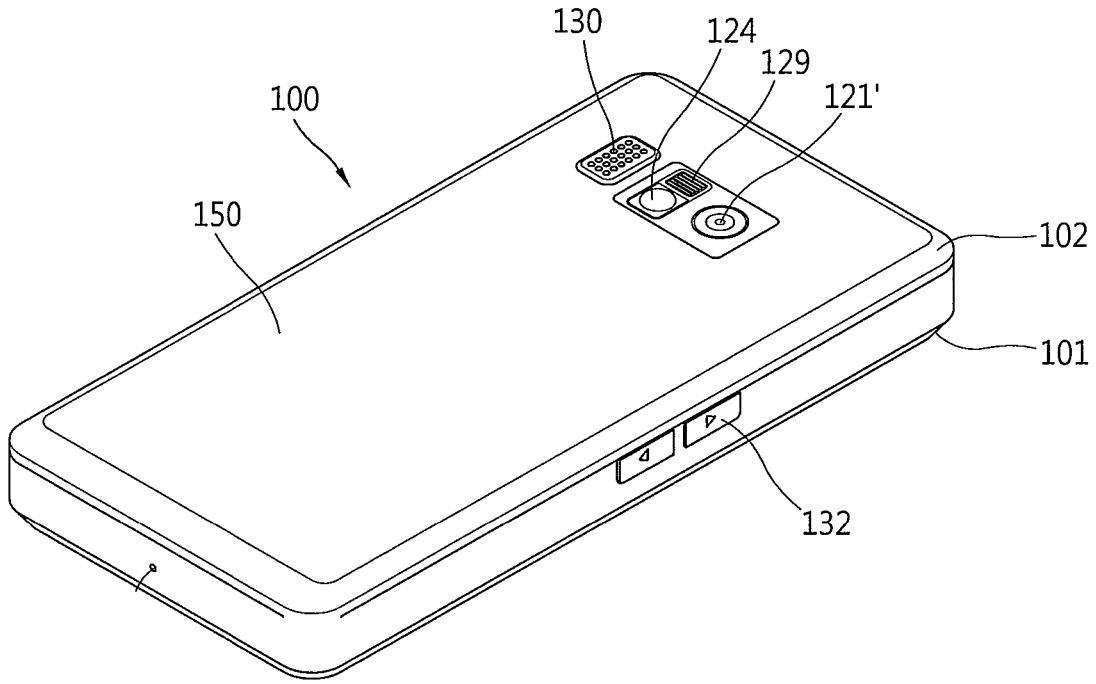
FIG. 2 is a rear perspective view illustrating the mobile terminal of FIG. 2.

FIG. 2 is a rear perspective view of the mobile terminal 100 of FIG. 1.

Referring to FIG. 2, a camera 121' may be additionally provided on the rear case 102. The camera 121' faces a direction which is opposite to a direction faced by the camera 121, and may have different pixels from those of the camera 121.

For example, the camera 121 may operate with relatively lower pixels (lower resolution). Thus, the camera 121 may be useful when a user can capture his face and send it to another party during a video call or the like. On the other hand, the camera 121' may operate with a relatively higher pixels (higher resolution) such that it can be useful for a user to obtain higher quality pictures for later use. The cameras 121 and 121' may be installed at a terminal body so as to rotate or pop-up.

A flash and a mirror 124 may be additionally disposed adjacent to the camera 121'. The flash operates in conjunction with the camera 121' when taking a picture using the camera 121'. The mirror 124 can cooperate with the camera 121' to allow a user to photograph himself or herself in a self-portrait mode.

An audio output unit may be additionally arranged on a rear surface of the terminal body. The audio output unit may cooperate with the audio output unit 152 disposed on a front surface of the terminal body so as to implement a stereo function. Also, the audio output unit may be configured to operate as a speakerphone.

A broadcast signal receiving antenna (not shown) as well as an antenna for calling may be disposed on a side surface of the terminal body. The broadcast signal receiving antenna which constitutes a part of a broadcasting receiving module may be configured to retract into the terminal body.

A power supply unit for supplying power to the mobile terminal 100 is mounted to the terminal body. The power supply unit may be mounted in the terminal body, or may be configured to be detachable from the outside of the terminal body. The power supply unit may be mounted in a battery cover 190.

A touch pad (not shown) for detecting touch may be additionally mounted to the rear case 102. The touch pad may be also configured to be transmissive like the display unit 151. When the display unit 151 is configured to output visual information from two surfaces, the visual information may be recognized even through the touch pad. The visual information output from the two surfaces of the display unit 151 may be controlled by the touch pad. A display may be additionally mounted to the touch pad, and a touch screen may be arranged at the rear case 102.

The touch pad interworks with the display unit 151 of the front case 101. The touch pad may be arranged at a rear side of the display unit 151 in parallel. This touch pad may have a size equal to or smaller than that of the display unit 151.

A power supply unit 150 for supplying power to the mobile terminal 100 is mounted to the terminal body. The power supply unit 150 may be mounted in the terminal body, or may be configured to be detachable from the outside of the terminal body.

Figure 3:
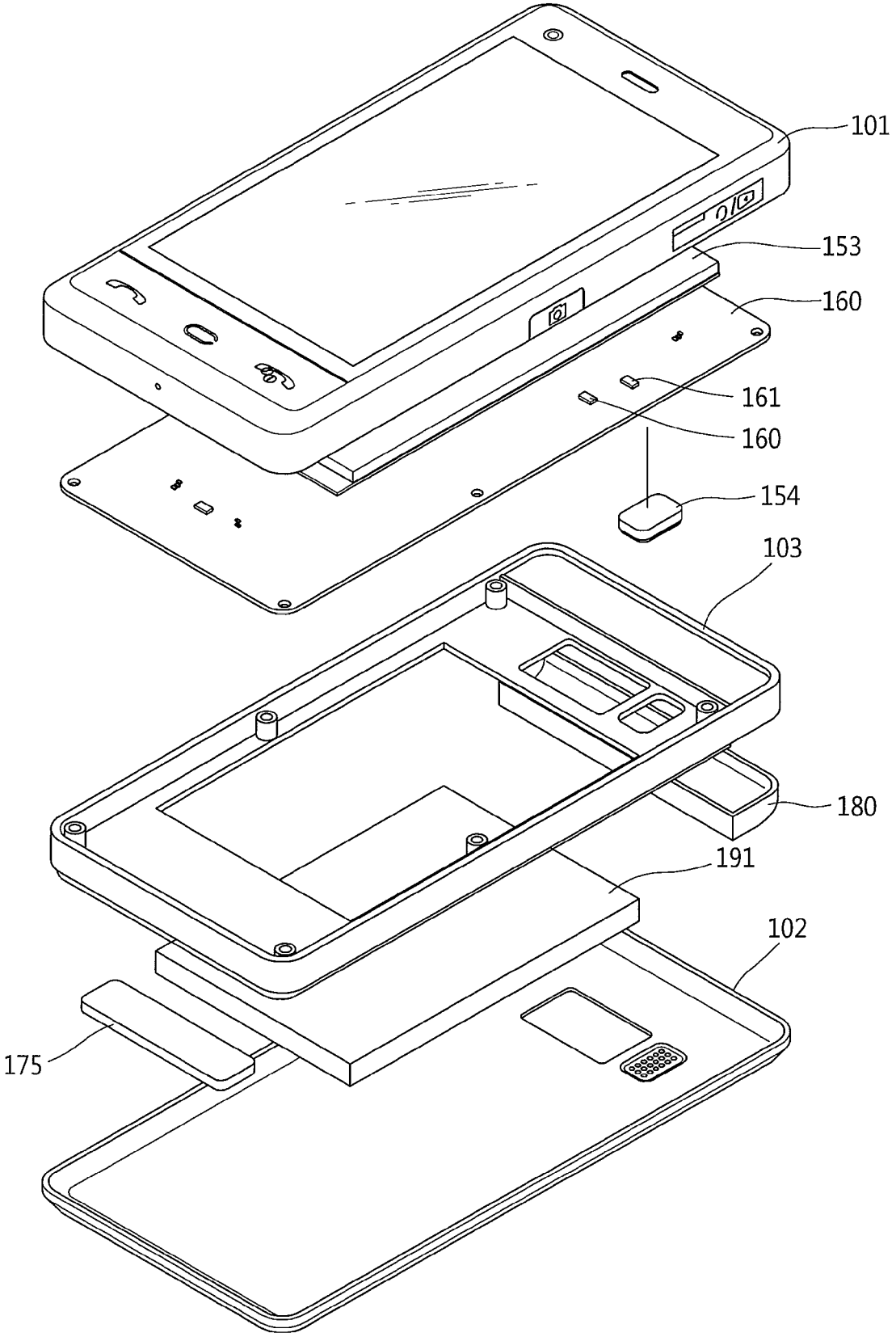
FIG. 3 is an exploded perspective view of FIG. 1.
Figure 4:
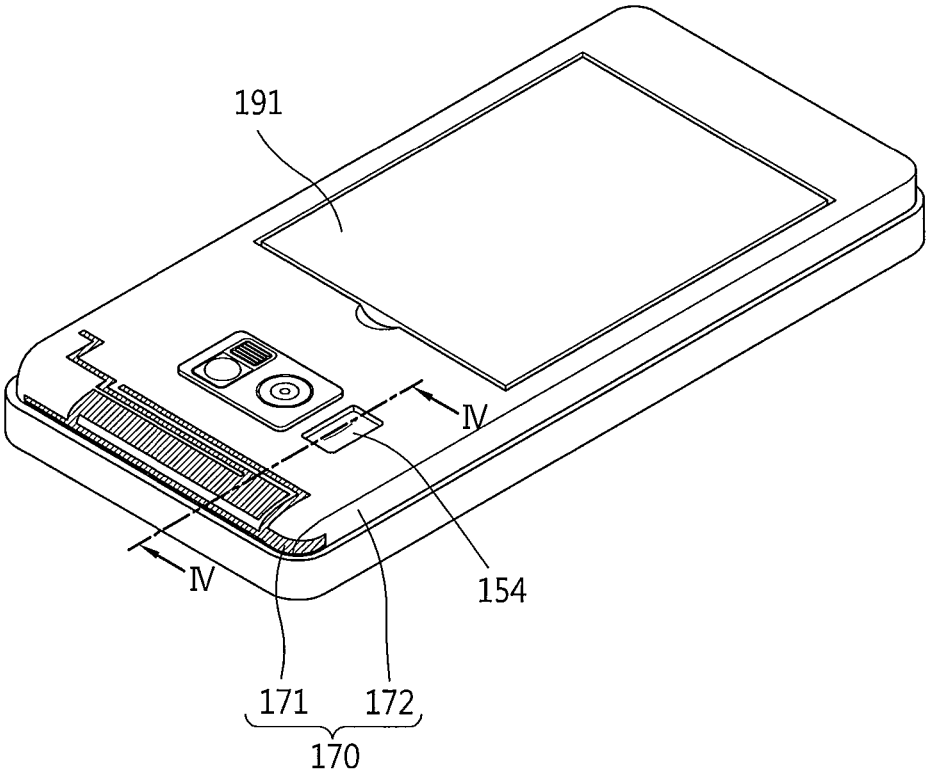
FIG. 4 is a rear perspective view illustrating the mobile terminal of FIG. 2 from which a rear case is removed.
Figure 5:
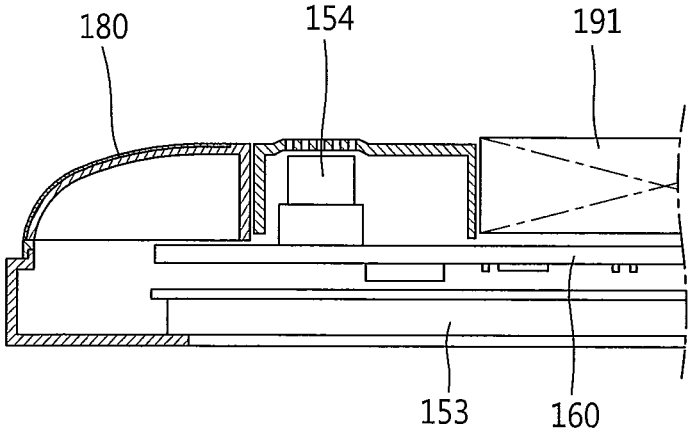
FIG. 5 is a conceptual cross-sectional diagram of the mobile terminal taken along the line IV-IV of FIG. 4.

FIG. 3 is an exploded perspective view of FIG. 1. FIG. 4 is a rear perspective view of the mobile terminal of FIG. 2 from which a rear case is removed. FIG. 5 is a conceptual cross-sectional diagram of the mobile terminal taken along the line IV-IV.

As shown in 3, the mobile terminal 100 according to the exemplary embodiment of the invention has an antenna device 180, at least part of which defines a loop. A display module 153 is mounted on one face of the first case 101, while a circuit board 160 is disposed to cover the display module 153.

Various types of electronic components are mounted on one face of the circuit board 160, and a shield member (not shown) may be mounted on the above face of the circuit board 160 to protect the electronic components. The shield member may be electrically connected to the circuit board 160 in order to extend a ground of the circuit board 160.

The circuit board 160 may be configured as one example of a controller to operate various functions of the mobile terminal 100. Here, the circuit board 160 may include a plurality of circuit boards 160, which can be combined to perform the functions of the controller. In addition, the circuit board 160 is electrically connected to the antenna device 180 and processes radio signals (or electromagnetic waves) that are transmitted and received by the antenna device 180. In order to process radio signals, a plurality of transceiver circuits may be formed or mounted on the circuit board 160.

Transceiver circuits 161 and 162 may be formed of at least one integrated circuit and relevant electrical components. In one example, transceiver circuits may include transmitter integrated circuits, receiver integrated circuits, switching circuits, and amplifiers.

The transceiver circuits 161 and 162 may operate at the same time by simultaneously feeding radiators that are composed of a plurality of conductive members 182. For example, while one transceiver circuit is performing transmission, the other may perform reception, or both of them may perform transmission or reception.

As shown in FIGS. 3 and 4, a battery 191 is disposed within the mobile terminal 100 as one example of a power supply unit. The battery 191 is received in a mounting member formed of a metal that creates a mounting space. The mounting member may be electrically connected to the circuit board 160 to thereby extend the ground of the circuit board 160. Further, ground layers of the mounting member, the shield member, and the circuit board 160 may be electrically connected to form the ground of the mobile terminal.

Then, part of the antenna device 180 may be connected to the case or the battery cover of the terminal body or a carrier 181 by heat fusion or compression (which means that a conductive metal plate to be a radiator is press-mounted on the carrier 181 formed of plastic having an appropriate shape). Alternatively, the antenna device 180 may be printed or formed into a film type, which may then be attached to one surface thereof. FIGS. 4 and 5 illustrate that conductive conductors are printed onto the carrier 181 that is bonded to an intermediate case 103. As such, the carrier 181 is arranged adjacent to one end of the terminal body. More specifically, the carrier 181 is disposed on an opposite side to the battery 191, and a speaker may be disposed between the carrier 181 and the battery 191.

The antenna device 180 according to the exemplary embodiment of the invention may include a plurality of antenna devices, which may be arranged adjacent to an upper end or a lower end of the terminal body. Alternatively, these antenna devices may be arranged adjacent to the side of the terminal body.

When the antenna device 180 includes a plurality of antenna devices, the antenna devices 180 may be one of an antenna formed to transmit and receive a radio signal corresponding to at least one of a PCS (personal communication system), an AWS (advanced wireless service), a DCN (digital communications network), and LTE (long term evolution); a broadcasting signal receiving antenna a operating at FM radio band or frequency band for Bluetooth or WI-FI; a Bluetooth antenna; a satellite signal receiving antenna; and a data receiving antenna of wireless Internet.

Among these antennas, the antenna devices 180 according to the exemplary embodiment of the invention may be used as the antenna that is formed to transmit and receive a radio signal corresponding to at least one of a PCS (personal communication system), an AWS (advanced wireless service), a DCN (digital communications network), and LTE (long term evolution). The antenna device 180 according to the exemplary embodiment of the invention is a smart antenna system to realize, for example, MIMO (Multi Input Multi Out) technology. The antenna device 180 may be regarded as a kind of "hybrid antenna" in that they are in charge of different bands and at the same time, have different forms.

As shown in FIGS. 4 and 5, the antenna devices 180 may be arranged adjacent to the upper end or the lower end of the terminal body, and electric components such as a speaker or a motor may be arranged between the antenna and the battery 191. The antenna device 180 may be separated from the electric components in consideration of emission efficiency of the electric components. However, since the antenna device 180 according to this embodiment has more enhanced antenna characteristics, the antenna device 180 may be arranged to cover at least part of the display module 153.

Figure 6:
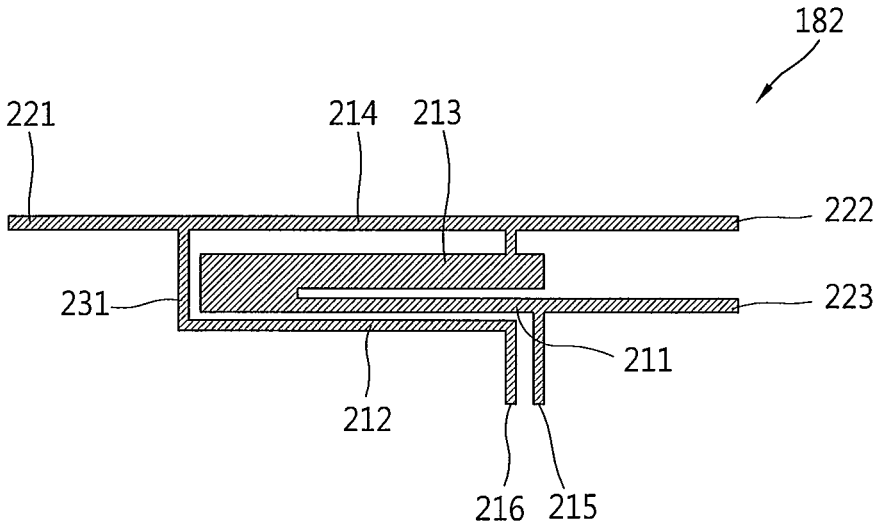
FIG. 6 is a conceptual diagram illustrating an antenna device according to an exemplary embodiment of the present invention.

FIG. 6 is a conceptual view illustrating the antenna device 180 according to the exemplary embodiment of the invention.

As shown in FIG. 6, the antenna device 180 includes the plurality of conductive members 182. The plurality of conductive members 182 extend in a first direction and are disposed to be spaced apart from each other. A set of ends of the plurality of conductive members 182 are connected to each other to form a loop. The plurality of conductive members 182 may be formed of at least a first conductive member 211 and a second conductive member 212 that extend in parallel with each other. The first conductive member 211 may be electrically connected to a feed connection portion 215 to feed the first conductive member 211, while the second conductive member 212 may be electrically connected to the ground to ground the second conductive member 212.

The first conductive member 211 and the second conductive member 212 are bent at portions connected to the feed connection portion 215 and the ground connection portion 216, respectively, and are then arranged adjacent to each other within a predetermined interval while extending in the first direction to achieve coupling therebetween. The predetermined distance may be less than one tenth of a wavelength corresponding to a particular frequency so that capacitive coupling can occur between the first conductive member 211 and the second conductive member 212. In order to increase a length by which the first conductive member 211 and the second conductive member 212 extend in the first direction in parallel with each other, the feed connection portion 215 connected to the first conductive member 211 to feed the first conductive member 211 and the ground connection portion 216 connected to the second conductive member 212 to ground the second conductive member 212 may be formed at respective ends of the first conductive member 211 and the second conductive member 212 that are away from the center, respectively.

As a result, capacitive coupling between the first conductive member 211 and the second conductive member 212 is increased, and therefore, a resonance length can be formed with a shorter path, thereby making the antenna smaller.

In order to ensure a sufficient resonance length, a third conductive member 213 and a fourth conductive member 214 may be added. In this case, in order to form a loop, one end of the third conductive member 213 is connected to the first conductive member 211, while the other end thereof is connected to the fourth conductive member 214. One end of the fourth conductive member 214 that is not connected to the third conductive member 213 is connected to the second conductive member 212, thereby forming a loop.

The third conductive member 213 is arranged adjacent to the first conductive member 211 so that inductive coupling can occur between the first conductive member 211 and the third conductive member 213. When inductive coupling occurs therebetween, the first conductive member 211 and the third conductive member 213 may have a planar patch design such that at least part thereof can operate as a PIFA (Planar Inverted F Antenna).

The first conductive member 211 and the second conductive member 212 may be formed in a first plane, and at least one of the third conductive member 213 and the fourth conductive member 214 may be formed in a second plane that crosses the first plane. Alternatively, the first, second, and third conductive members 211, 212, and 213 may be formed in the first plane, while the fourth conductive member may be formed in the second plane. The first plane may be any one of the top and bottom surfaces of the terminal body, and the second plane may be any one of the side surfaces of the terminal body. In this manner, the mobile terminal can be more reduced. The antenna device 180 is configured in the above-described manner. Here, in the antenna device 180, the carrier 181 and the conductive members have a volume of 2200 $mm^3$ or less.

In addition, in order that the antenna device 180 can operate in multi resonance mode in a high frequency band, a fifth conductive member that extends from midway between the feed connection portion 215 and the first conductive member 211 may be further included.

The first conductive member 211 may be ground-connected to the circuit board 160 having the ground by the ground connection portion 216. The ground connection portion 216 is ground-connected to the first conductive member 211 and is electrically short-circuited, thereby enabling antenna resonance frequency and achieving impedance matching. The distance between the feed connection portion 215 and the ground connection portion 216 may be controlled for impedance matching. In one example, the smaller the distance between the feed connection portion 215 and the ground connection portion 216 is, the smaller bandwidth is, while the greater the distance therebetween is, the more impedance increases.

The ground connection portion 216 electrically connects an electrical ground to one end of the first conductive member 211 to ground the first conductive member 211. The electrical ground may be the ground of the circuit board 160.

Here, the ground connection portion 216 may have at least two paths with different lengths and switches corresponding to the respective paths. In addition, through the switches used to select the respective paths, the respective paths selectively connect the electrical ground and radiators (including, for example, the first conductive member) in different lengths. Here, this path is an electrical path through which ground and radiators are connected to each other and may include a ground plate, a ground clip, and a ground line. Also, by forming ground lines with different lengths, the lengths of the paths may be different from each other.

The second conductive member 212 and the circuit board 160 are electrically connected to each other by the feed connection portion 215 to feed the second conductive member 212. The feed connection portion 215 feeds the second conductive member 212 by electrical connection (or EM (Electro-Magnetic) feed method). The feed connection portion 215 electrically connects a feed unit (not shown) and the second conductive member 212.

For this connection, the feed connection portion 215 may include a feed plate, a feed clip, and a feed line. Here, the feed plate, the feed clip, and the feed line are electrically connected to each other, thereby transferring current (or voltage) that is fed by the feed unit to the conductors of the radiators. Here, the feed line may include microstrip that is printed on the board.

At least part of the plurality of conductive members 182 include conductors and operate as radiators. The plurality of conductive members 182 may be manufactured into various shapes according to resonance or frequency characteristics. Current is fed into the conductor through the feed connection portion 215, and the current that is fed is short circuited by the ground connection portion 216.

In order to gain sufficient antenna characteristics while transmitting and receiving radio signals in the LTE (long term evolution) band, the antenna device 180 needs to form an electrical length of $\lambda/4$ with a frequency of 700 MHz or more. The entire antenna size needs to be increased correspondingly. However, since the size of the antenna is limited in line with the reduction in size of the terminal, the antenna needs to be more reduced and achieve improved performance in a low frequency band.

As described above, the first conductive member 211 to the fourth conductive member 214 are connected to each other to form a folded dipole structure. The third conductive member 213 has a planar patch configuration. Coupling ground occurs between the third conductive member 213 and the first conductive member 211 or between the first conductive member 211 and the second conductive member 212 to thereby form a PIFA structure. Since an electric source is provided in a PIFA, and a magnetic source is provided in a folded dipole antenna (FDA), the antenna device 180 according to the exemplary embodiment of the invention can operate as a hybrid antenna that has an electric source and a magnetic source.

Figure 7:
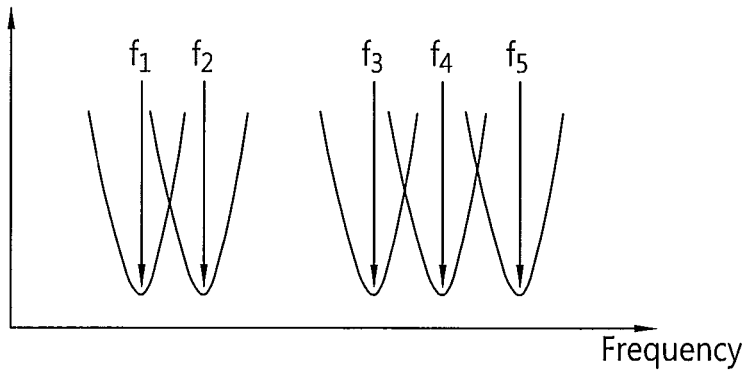
FIG. 7 is a graph illustrating central frequencies according to the exemplary embodiment of the present invention.

FIG. 7 is a graph illustrating central frequencies related according to the exemplary embodiment of the present invention. FIGS. 8A to 8D are conceptual views illustrating current distributions corresponding to the central frequencies of FIG. 7.

The central frequencies as shown in FIG. 7 correspond to low-frequency band, LTE (long term evolution) band (from 700 to 787 MHz and hereinafter referred to as "f1" in FIG. 7), GSM (Global System for Mobile communication) band (from 850 to 950 MHz and hereinafter referred to as "f2" in FIG. 7), DCS (Digital Cellular System) and PCS (Personal Communication System) bands (from 1700 to 1900 MHz and hereinafter referred to as "f3 and f4" in FIG. 7, respectively), and WCDMA (Wideband CDMA) communications band (of 2.4 GHz and hereinafter referred to as "f5" in FIG. 7). The antenna device 180 according to the exemplary embodiment of the invention operates in a dual resonance mode in a low frequency band and in a multi resonance mode in a high frequency band. In order that the antenna device 180 operates in a dual resonance mode in a low frequency band, the first conductive member 211, the second conductive member 212, and the third conductive member 213 are extended in parallel with each other by predetermined lengths and form a loop so that at least capacitive coupling or inductive coupling can occur therebetween. In addition, in order that the antenna device 180 operates in a multi resonance mode in a high frequency band, as shown in FIG. 6, one or more slits are formed between the conductive members, one or more sub-conductive members 221 and 222 that extend from the conductive members are included. Since such slits can serve as one capacitor in the antenna, the antenna can be tuned according to the lengths or distances of the slits and dielectric constants of the materials that fill the slit.

Figure 8A:
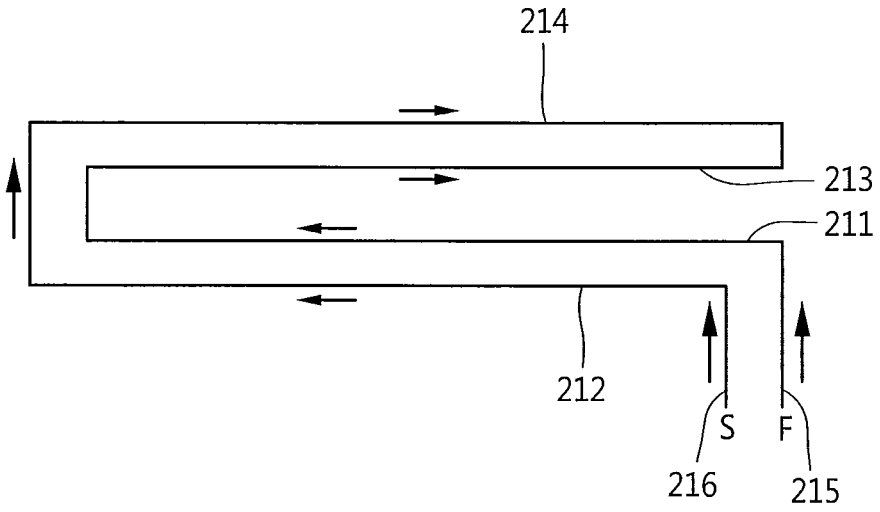
FIGS. 8A through 8D are conceptual views illustrating current distributions corresponding to the central frequencies of FIG. 7.
Figure 8B:
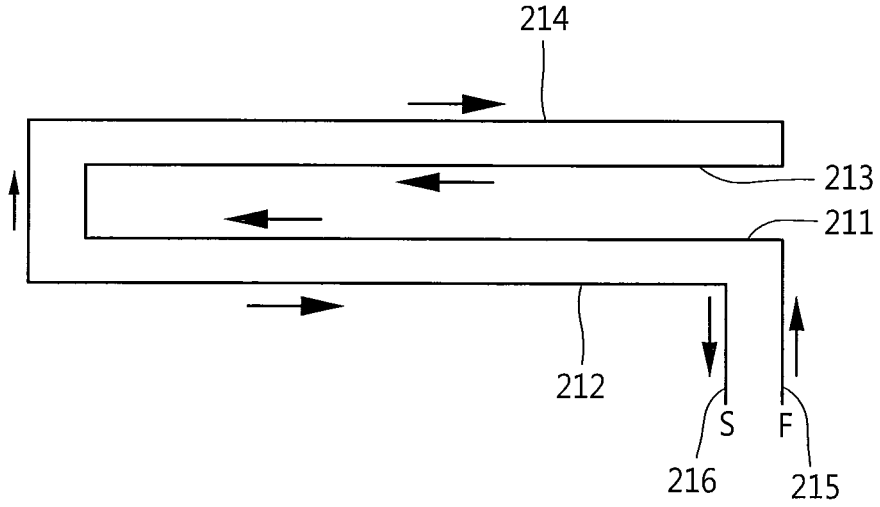

FIGS. 8A and 8B are diagrams illustrating current distributions of the antenna device 180 according to the exemplary embodiment of the invention that is a loop antenna operating in a common mode and a differential mode, respectively.

In a common mode, currents flow through the first conductive member 211 and the second conductive member 212 and through the third conductive member 213 and the fourth conductive member 214 in the same direction, and coupling occurs at least between the first conductive member 211 and the second conductive member 212, so that the maximum resonance length can be formed to transmit and receive radio signals corresponding to the LTE band (f1). In a differential mode, currents flow through the first conductive member 211 and the second conductive member 212 and through the third conductive member 213 and the fourth conductive member 214 in opposite directions so that a resonance length can be formed to transmit and receive radio signals corresponding to the DCS band (f3). As such, by increasing capacity between the conductive members and the ground of the circuit board, resonance frequency can be reduced in the common mode and the differential mode. That is, desired low-frequency band performance can be achieved with a shorter resonance length.

Figure 8C:
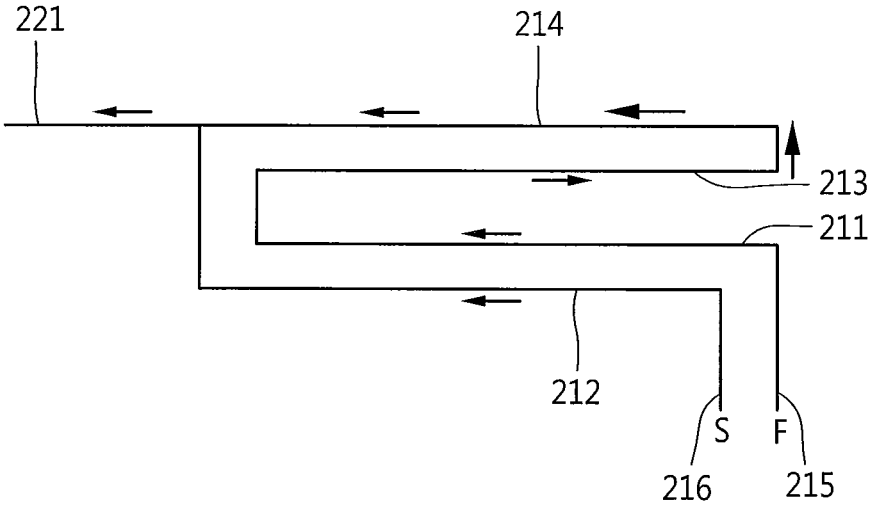

FIG. 8C is a diagram illustrating current distribution when the antenna device 180 according to the exemplary embodiment of the invention serves as a PIFA. Emission occurs around one end of the sub-conductive member 221 extending from the fourth conductive member 214 to the left side, and emitted radio frequency corresponds to the GSM band (f2). At this time, coupling ground may occur at least between the third conductive member 213 and the first conductive member 211 or between the first conductive member 211 and the second conductive member 212.

The sub-conductive member 221 may be bent from the fourth conductive member 214. For example, when the third conductive member 213 and the fourth conductive member 214 are formed in the first plane, the sub-conductive member 221 may be formed in the second plane crossing the first plane. In this manner, a path from the feed connection portion 215 to the sub-conductive member 221 via the respective conductive members can form a physical length to transmit and receive radio signals corresponding to a particular frequency.

Figure 8D:
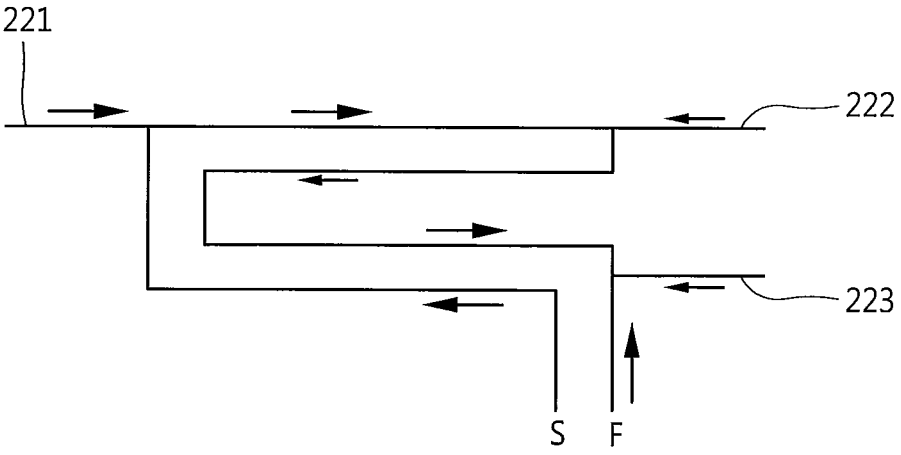

FIG. 8D is a diagram illustrating a fifth conductive member 223 that extends from midway between the feed connection portion 215 and the first conductive member 211 and the sub-conductive member 222 that extends from the fourth conductive member 214 in one direction so that the antenna device 180 according to the exemplary embodiment of the invention can operate in multi resonance mode. Radio signals corresponding to the WCDMA band (f5) can be transmitted and received around one end of the fifth conductive member 223, and radio signals corresponding to the PCS band (f4) can be transmitted and received around one end of the sub-conductive member 222.

The fifth conductive member 223 and the sub-conductive member may be bent in one plane in which the first conductive member 211 and the fourth conductive member 214 are formed. For example, when the third conductive member 213 and the fourth conductive member 214 are formed in the first plane, the sub-conductive member 222 may be formed in the second plane crossing the first plane. As a result, the fifth conductive member 223 and the sub-conductive member 222 can be coupled to the ground of the circuit board at a plurality of points.

Figure 9:
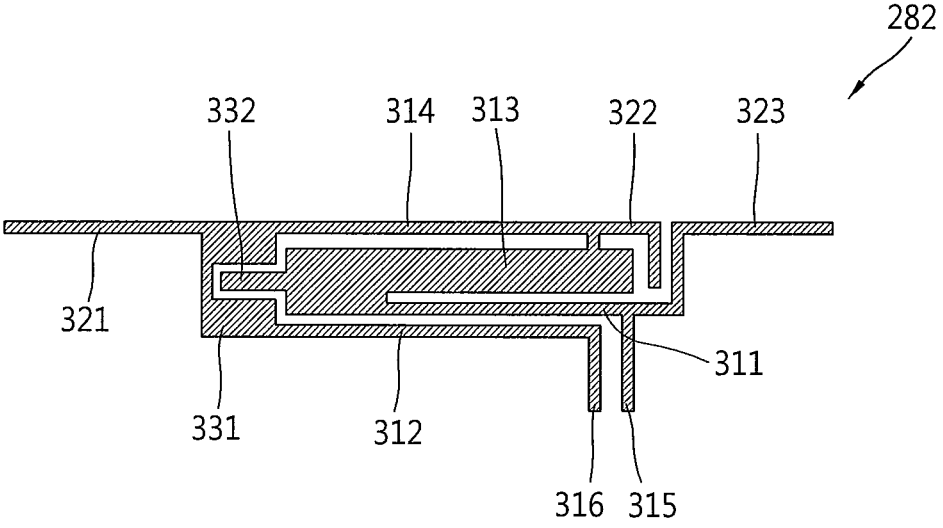
FIG. 9 is a conceptual diagram illustrating an antenna device according to a modification of the present invention.

FIG. 9 is a conceptual view illustrating an antenna device according to a modification of the present invention.

An antenna device may include a plurality of conductive members 282. The plurality of conductive members 282 extend in a first direction and are separated from each other. Also, a set of ends of the conductive members 282 are connected to each other to form a loop. The plurality of conductive members 282 may be formed of at least a first conductive member 311 and a second conductive member 312 that extend in parallel with each other. The first conductive member 311 may be connected to a feed connection portion 315 to feed the first conductive member 311, while the second conductive member 312 may be connected to the ground to ground the second conductive member 312.

The first conductive member 311 and the second conductive member 312 are bent at portions connected to a feed connection portion 315 and a ground connection portion 316, and are arranged adjacent to each other within a predetermined interval while extending in the first direction so that coupling occurs between the first conductive member 311 and the second conductive member 312. The predetermined interval is less than one tenth of a wavelength corresponding to a particular frequency so that capacitive coupling can occur between the first conductive member 311 and the second conductive member 312. In addition, in order to increase a length by which the first conductive member 311 and the second conductive member 312 extend in the first direction in parallel with each other in the first direction, the feed connection portion 315 electrically connected to the first conductive member 311 to feed the first conductive member 311 and the ground connection portion 316 electrically connected to the second conductive member 312 to ground the second conductive member 312 are formed at respective ends of the first conductive member 311 and the second conductive member 312 that are away from the center, respectively.

Unlike FIG. 6, a fifth conductive member 323 extends from one end of the first conductive member 311 and is bent multiple times in order to form a resonance length. In addition, one end of the third conductive member 313 extends toward a connecting portion 331 that connects the second conductive member 312 and the fourth conductive member 314. The connecting portion 331 and the third conductive member 313 are arranged adjacent to each other so that coupling occurs therebetween. As shown in FIG. 9, the connecting portion 331 has a recess, and a protruding portion 332 of the third conductive member 313 extends to the recess. In this manner, a length of a slit that connects the feed connection portion 315 and the ground connection portion 316 and the third conductive member 313 and the fourth conductive member 314 is increased by a length to which the connecting portion 331 of the third conductive member 313 extends to the recess, thereby facilitating frequency matching. That is, resonance frequency becomes shorter so as to transmit and receive radio signals in low frequency band. In addition, when compared with the connection portion 231 of FIG. 6, bandwidth is increased because of the area of the connecting portion 331 added, and capacity can be increased by a gap between the protruding portion 332 of the third conductive member 313 and the connecting portion 331. That is, since resonance frequency can be reduced in both common mode and differential mode, low-frequency band performance, particularly, enhanced antenna performance in LTE band can be achieved with a shorter resonance length.

Figure 10:
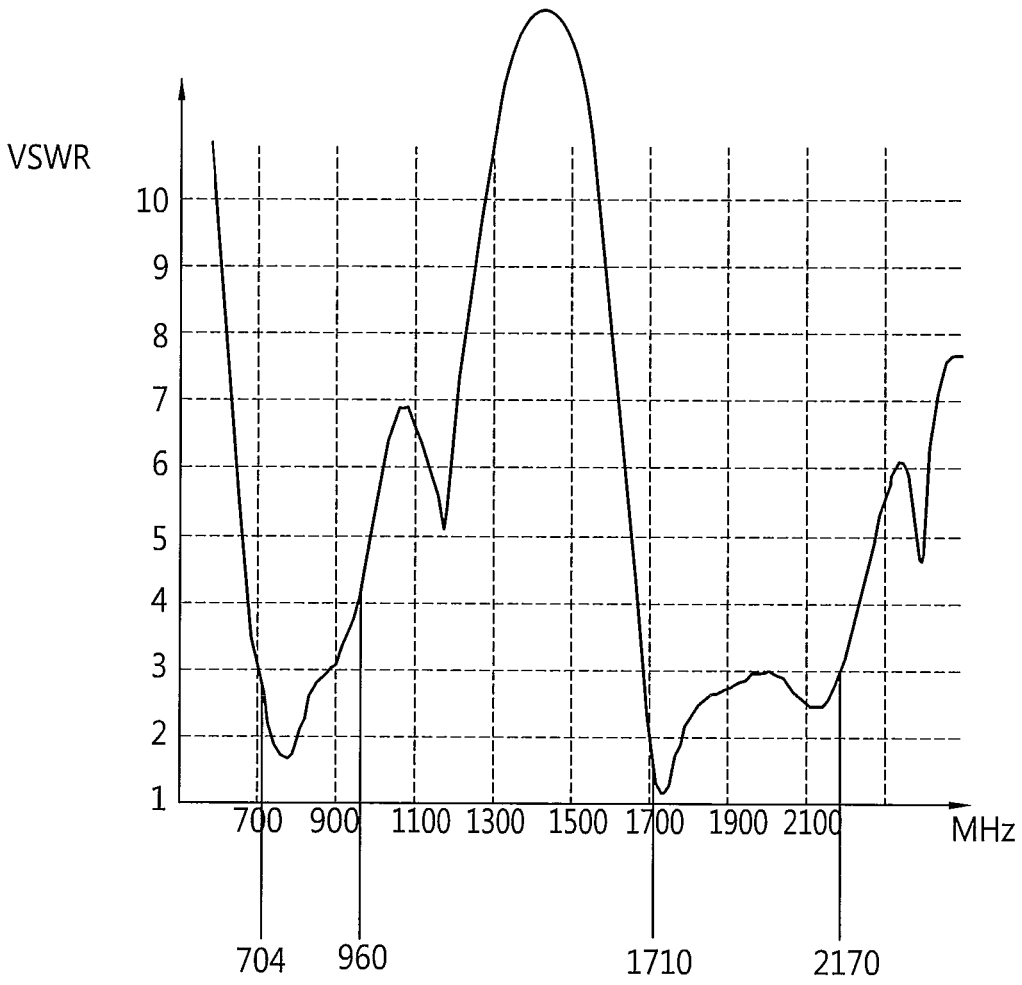
FIG. 10 is a graph illustrating voltage standing wave ratio (VSWR) of the mobile terminal of FIG. 4.

FIG. 10 is a graph illustrating voltage standing wave ratio (VSWR) of the mobile terminal as shown in FIG. 4.

Referring to FIG. 10, the mobile terminal 100 according to the exemplary embodiment of the invention has wideband antenna characteristics with a resonance frequency from 700 to 960 MHz. According to the graph of FIG. 10, the mobile terminal as shown in FIG. 4 can realize primary antenna characteristics from 746 to 894 MHz and secondary MIMO antenna characteristics from 746 to 756 MHz. As such, the antenna device 180 according to this exemplary embodiment can achieve wideband characteristics in a low frequency band of 1 GHz or less and also show wideband characteristics at another band in addition to the LTE band.

The above-described mobile terminal is not limited to the configuration and method according to the exemplary embodiments as described above, but the entirety or some of the exemplary embodiments may be selectively combined to make various modifications.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal body having a ground; and conductive members embedded in the terminal body, extended to form a loop, wherein the conductive members include first to fifth conductive members, wherein the first conductive member is electrically connected to a feed connection portion to feed the conductive members, wherein the second conductive member is electrically connected to the ground to ground the conductive members, wherein the first and second conductive members are separated from each other and arranged adjacent to each other, have extending portions which are extended in parallel to each other, and are coupled at the extending portions to transmit and receive a radio signal, wherein the third and fourth conductive members are extended in parallel to each other and which are in opposite directions to the first and second conductive members, wherein, in order to form the loop, the third conductive member has one end connected to the first conductive member and the other end connected to the fourth conductive member, and the fourth conductive member is connected to the second conductive member by a connecting portion, wherein, in order to operate in a dual resonance mode in a first part of a frequency band, the first conductive member and the second conductive member are disposed to be spaced apart from each other by a first interval to achieve capacitive coupling, and the first conductive member and the third conductive member are disposed to be spaced apart from each other by a second interval to achieve inductive coupling, wherein, in order to operate in a multi resonance mode in a second part of the frequency band, at least one slit is formed between the conductive members, and sub-conductive members are extended from both ends of the fourth conductive member, wherein the fifth conductive member extends from the first conductive member at a connection between the ground and the first conductive member, the fifth conductive member being bent multiple times to form a resonance length, and wherein the connecting portion has a recess, the third conductive member has a protruding portion which is extended into the recess, and the connecting portion surrounds the protruding portion so that coupling occurs between the connecting portion and the third conductive member.

2. The mobile terminal of claim 1, wherein the third conductive member and the fourth conductive member are disposed to be spaced apart from the first conductive member or the second conductive member respectively.

3. The mobile terminal of claim 1, wherein a path from one end of the first conductive member to be fed to the second conductive member to be grounded via the third conductive member and the fourth conductive member is formed to transmit and receive a first frequency band corresponding to long term evolution (LTE).

4. The mobile terminal of claim 3, wherein the first conductive member and the second conductive member are coupled to each other in order to form a physical length corresponding to the first frequency band within a limited space of the terminal body.

5. The mobile terminal of claim 4, wherein the conductive members further includes a ground connection portion, and wherein the feed connection portion and the ground connection portion are arranged away from central areas of the first and second conductive members in order to form the physical length.

6. The mobile terminal of claim 2, wherein the third conductive member is formed as a planar patch.

7. The mobile terminal of claim 6, wherein a path from one end of the first conductive member to be fed to the third conductive member formed as the planar patch is formed to transmit and receive a second frequency band corresponding to GSM 850 and GSM 900.

8. The mobile terminal of claim 7, wherein the feed connection portion is arranged away from a central area of the first conductive member so that the third conductive member operates as part of a planar inverted f antenna (PIFA) in the second frequency band.

9. The mobile terminal of claim 2, wherein the first conductive member and the second conductive member are formed in a first plane, and at least one of the third conductive member and the fourth conductive member is formed in a second plane crossing the first plane.

10. The mobile terminal of claim 9, wherein the first plane is any one of a top surface and a bottom surface of the terminal body, and the second plane is any one of side surfaces of the terminal body.

11. The mobile terminal of claim 9, wherein a carrier is mounted adjacent to one end of the terminal body, and the conductive members are arranged at one surface of the carrier.

12. The mobile terminal of claim 11, wherein the carrier and the conductive members have a volume of 2200 $mm^3$ or less.

13. A mobile terminal comprising:

a terminal body having a ground; and a plurality of conductive members embedded in the terminal body and extended to form a loop, wherein the conductive members have first to fifth conductive members, wherein the first conductive member is arranged between the second conductive member and the third conductive member, and is electrically connected to a feed connection portion to feed the conductive members, wherein the third and fourth conductive members are extended in parallel to each other and which are in opposite directions to the first and second conductive members, wherein, in order to form the loop, the third conductive member has one end connected to the first conductive member and the other end connected to the fourth conductive member, and the fourth conductive member is connected to the second conductive member by a connecting portion, wherein, in order to operate in a dual resonance mode in a first part of a frequency band, the first conductive member and the second conductive member are disposed to be spaced apart from each other by a first interval to achieve capacitive coupling, and the first conductive member and the third conductive member are disposed to be spaced apart from each other by a second interval to achieve inductive coupling, wherein, in order to operate in a multi resonance mode in a second part of the frequency band, at least one slit is formed between the conductive members, and sub-conductive members are extended from both ends of the fourth conductive member, wherein the fifth conductive member extends from the first conductive member at a connection between the ground and the first conductive member, the fifth conductive member being bent multiple times to form a resonance length, and wherein the connecting portion has a recess, the third conductive member has a protruding portion which is extended into the recess, and the connecting portion surrounds the protruding portion so that coupling occurs between the connecting portion and the third conductive member.

14. The mobile terminal of claim 13, wherein the fourth conductive member is disposed to be spaced apart from the third conductive member by a third interval so that a path passing through the plurality of conductive members is formed to transmit and receive a first frequency band corresponding to LTE (long term evolution).

15. The mobile terminal of claim 14, wherein the first conductive member and the second conductive member are coupled to each other in order to form a physical length corresponding to the first frequency band within a limited space of the terminal body.

16. The mobile terminal of claim 15, wherein the conductive members further includes a ground connection portion, and wherein the feed connection portion and the ground connection portion are arranged away from central areas of the first and second conductive members in order to form the physical length.

17. The mobile terminal of claim 13, wherein the third conductive member is formed as a planar patch.

18. The mobile terminal of claim 17, wherein a path from one end of the first conductive member to be fed to the third conductive member formed as the planar patch is formed to transmit and receive a second frequency band corresponding to GSM 850 and GSM 900.

19. The mobile terminal of claim 18, wherein the feed connection portion is arranged adjacent to an end portion of the first conductive member so that the third conductive member operates as part of a planar inverted f antenna (PIFA) in the second frequency band.

* * * * *